US006572436B1

(12) United States Patent
So

(10) Patent No.: US 6,572,436 B1
(45) Date of Patent: Jun. 3, 2003

(54) TOY STATION

(75) Inventor: Moon-Lam So, Kowloon (CN)

(73) Assignee: May Cheong Toy Products Factory Limited, Kowloon (HK)

( * ) Notice: Subject to any disclaimer, the term of this patent is extended or adjusted under 35 U.S.C. 154(b) by 0 days.

(21) Appl. No.: 10/071,065

(22) Filed: Feb. 7, 2002

(51) Int. Cl.[7] ..... A63H 3/52; A63H 33/30

(52) U.S. Cl. ..... 446/478; 446/73; 446/75; 446/71; 446/487

(58) Field of Search ..... 446/478, 487, 446/71, 73, 75, 76, 77, 78

(56) References Cited

U.S. PATENT DOCUMENTS 3,670,449 A * 6/1972 Lemkin et al.
4,209,934 A * 7/1980 Ogawa
4,349,983 A * 9/1982 Kilroy et al.
4,433,504 A * 2/1984 Terui
4,516,948 A * 5/1985 Obara ..... 446/95
4,755,159 A * 7/1988 Templeton et al. ..... 446/76
5,013,278 A * 5/1991 Dixon et al. ..... 446/73
5,152,710 A * 10/1992 Montgomery ..... 446/75
5,542,870 A * 8/1996 Westersund ..... 446/75
5,643,038 A * 7/1997 Olsen et al. ..... 446/75
6,203,017 B1 * 3/2001 Schultz ..... 273/285

FOREIGN PATENT DOCUMENTS

GB 2 178 331 A * 2/1987

* cited by examiner

*Primary Examiner*—Derris H. Banks
*Assistant Examiner*—Ali Abdelwahed
(74) *Attorney, Agent, or Firm*—Alix, Yale & Ristas, LLP

(57) ABSTRACT

A modular toy station is transformable from a closed storage configuration to an open in-use configuration providing a play surface. The station includes a box section and a platform. The box section is hingedly connected to the platform so as to pivot from a storage configuration to an in-use play configuration. The platform has features typically like those of a service station extending from it, which are concealed by the box section in the storage configuration and which extend upwardly from the platform in the in-use play configuration. The toy station further includes a recessed ledge at an edge of the platform configured to support a tab of an ancillary item such as a ramp joining piece.

8 Claims, 7 Drawing Sheets

TOY STATION

BACKGROUND OF THE INVENTION

The present invention relates to a toy station. More particularly, though not exclusively, the invention relates to a modular box that can be transformed from a closed storage configuration to a play configuration including a play surface, wherein features extending from the play surface are concealed within the box in the closed storage configuration.

BACKGROUND OF THE INVENTION

It is an object of the present invention to provide a modular toy station being transformable from a closed, storage configuration to an open in-use configuration providing a play surface.

It is a further object of the present invention to provide a modular toy station including connection means by which the station can be connected to another like station by a bridge.

It is yet a further object of the present invention to provide a modular toy station including connection means by which a ramp can be affixed to: the station adjacent an upper play surface thereof.

It is a general object of the present invention to provide a modular toy station that is fun for children.

DISCLOSURE OF THE INVENTION

There is disclosed herein a modular toy station being transformable from a closed storage configuration to an in-use configuration providing a play surface, the station including a box section and a platform, the box section being hingedly connected to the platform so as to pivot from the storage configuration to the in-use play configuration, the platform having features extending therefrom which are concealed by the box section in the storage configuration and which extend upwardly from the platform in the in-use play configuration, the toy station further including a recessed ledge at an edge of the platform configured to support a tab of an ancillary item.

Preferably the ancillary item is a joiner for a ramp or bridge piece.

Preferably there are two said box sections, each being hingedly attached to the platform.

Preferably the box sections are hingedly attached alongside respective opposed edges of the platform.

Preferably each box section has a wall with an aperture therethrough, and through which a said tab passes to be received by the ledge.

In combination with the above-disclosed module, there is further disclosed herein a ramp having a joiner with a tab, the tab engaging with the ledge.

There is further disclosed herein a pair of the above-disclosed modules connected to each other by a bridge having a joiner at each end thereof, each joiner engaging with a ledge of one of the modules.

Preferably the platform provides a surface for toy vehicles.

Preferably the features extending from the platform are service station features.

BRIEF DESCRIPTION OF THE DRAWINGS

A preferred form of the present invention will now be described by way of example with reference to the accompanying drawings, wherein.

DESCRIPTION OF THE PREFERRED EMBODIMENTS

Figure 1:
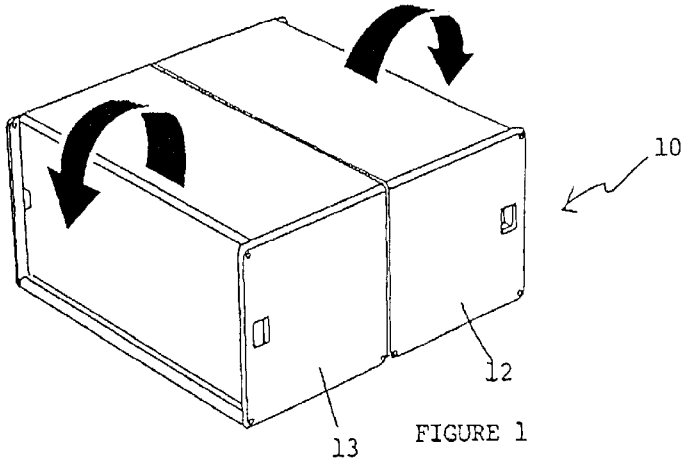
FIG. 1 is a perspective illustration of a module in a storage configuration.
Figure 2:
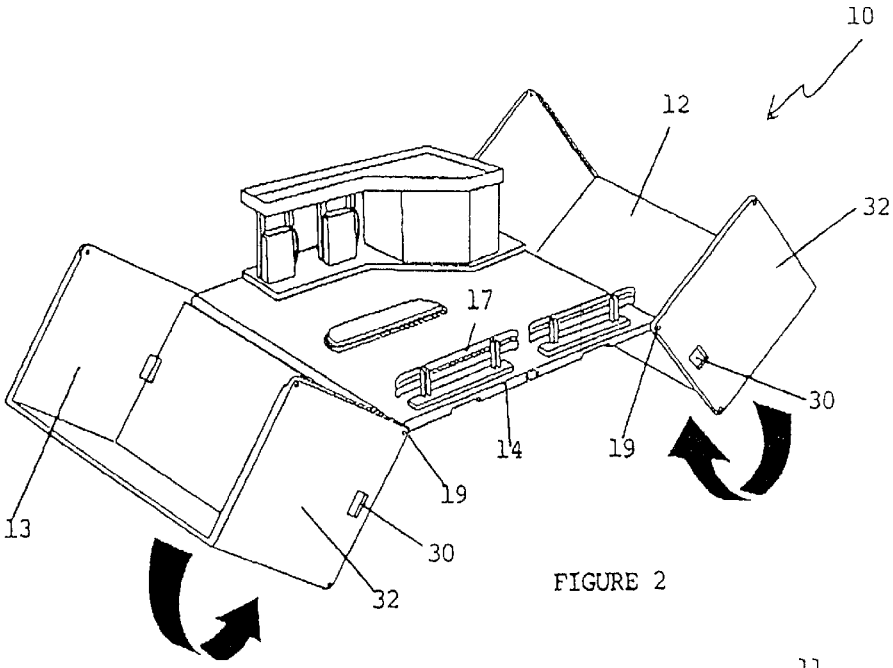
FIG. 2 is a perspective illustration of the module of FIG. 1 in a partly out-folded configuration.

In FIG. 1 of the accompanying drawings there is schematically depicted a module 10 in a closed storage configuration. The module is in the form of a closed box and is made up to a pair of box halves 12 and 13. As shown in FIG. 2, the box halves are hingedly connected at 19 to a platform 14 at respective opposed edges thereof.

Figure 3:
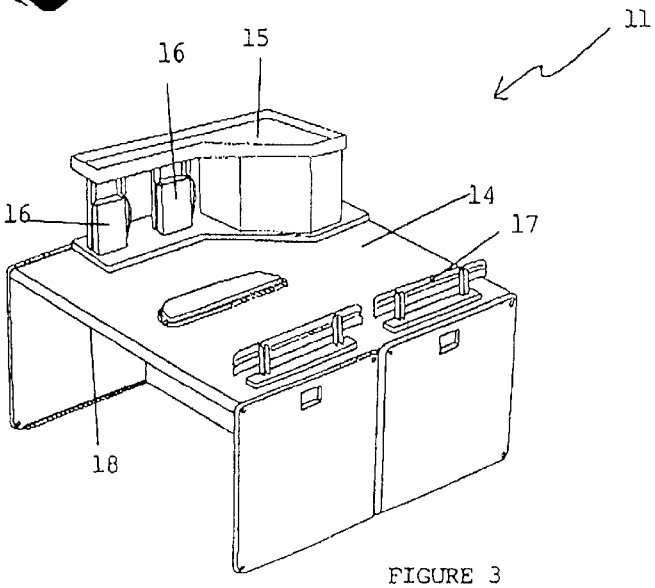
FIG. 3 is a perspective illustration of the module of FIGS. 1 and 2 in a play configuration.

FIG. 3 shows a transformed configuration 11 of the module 10. In this configuration, the platform 14 has its play surface exposed for use. In the configuration of FIG. 1 the play surface still faces upwardly, but is concealed by the box halves 12 and 13. This might enable plague pieces for toy cars for example to be retained in their last played position and stored.

The play surface of the platform 14 might be in the form of a service station having bowsers 16, guard rails 17 and a shop 15 for example. As an alternative, the play surface could be a miniature playground, garden, game board or anything else that children might enjoy. The platform includes an edge 18 to which a bridge or ramp can be affixed.

Figure 4:
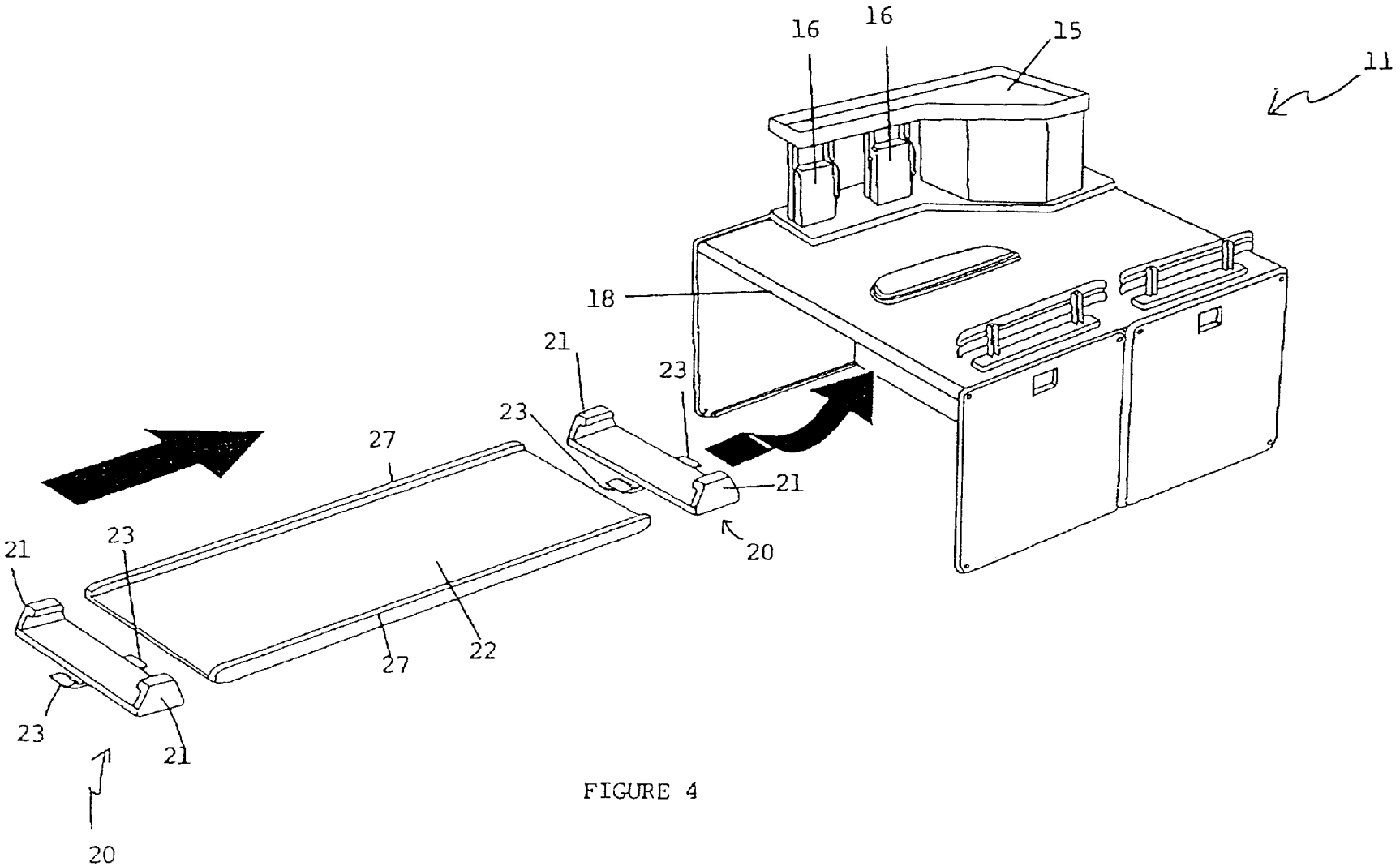
FIG. 4 is a perspective illustration of the module in the configuration of FIG. 3 with a bridge together with a pair of joiners ready to be connected thereto.

As shown in FIG. 4, a bridge or ramp piece 22 can be connected to the edge 18 by use of a joiner 20. The bridge or ramp piece 22 has a pair of opposed rails 27. Side clips 21 of the joiner 20 receive these rails of the bridge 22. The joiner 20 also includes a pair of tabs 23.

Figure 5:
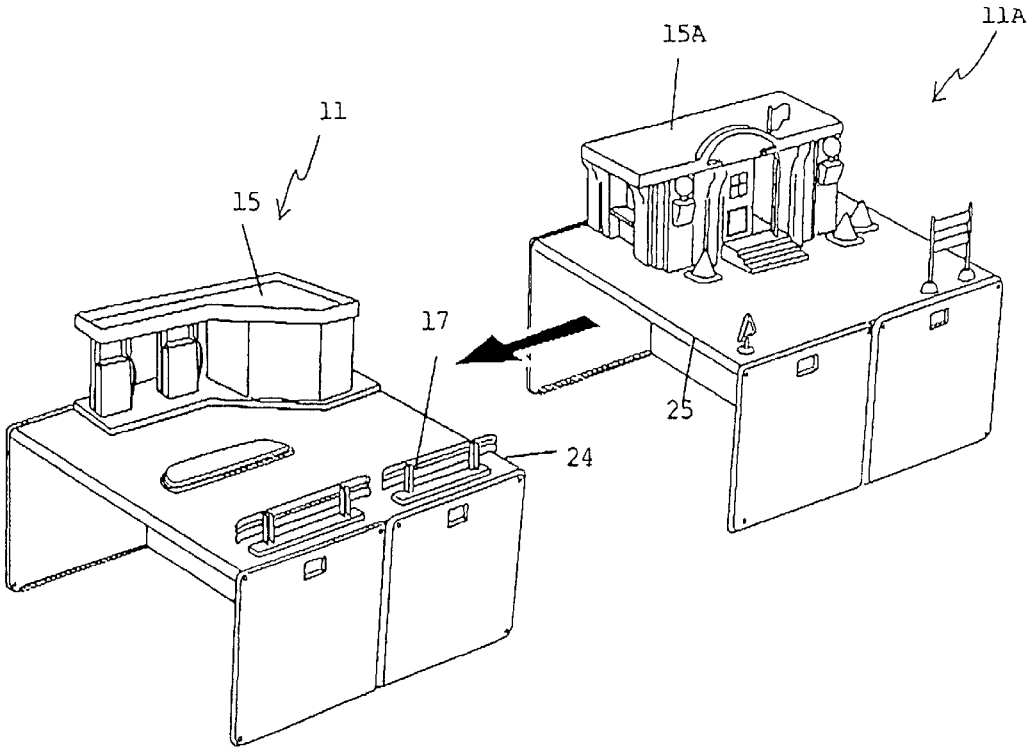
FIG. 5 is a perspective illustration of the module of FIG. 3 and another similar module to be positioned in a touching side-by-side configuration.
Figure 6:
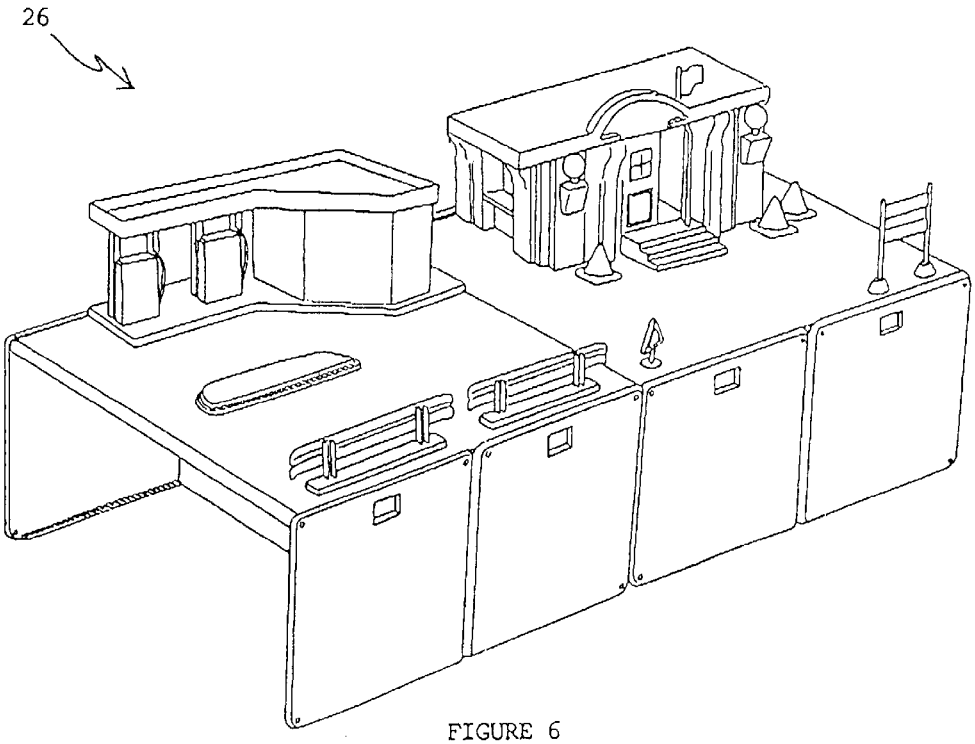
FIG. 6 is a perspective illustration of the modules of FIG. 5 in a touching side-by-side configuration.

As shown in FIG. 5, another module 11A which has a building 15A on it can be configured in much the same manner as module 11 is configured. These modules can be positioned in touching side-by-side relationship 26 as shown in FIG. 6 for example.

Figure 7:
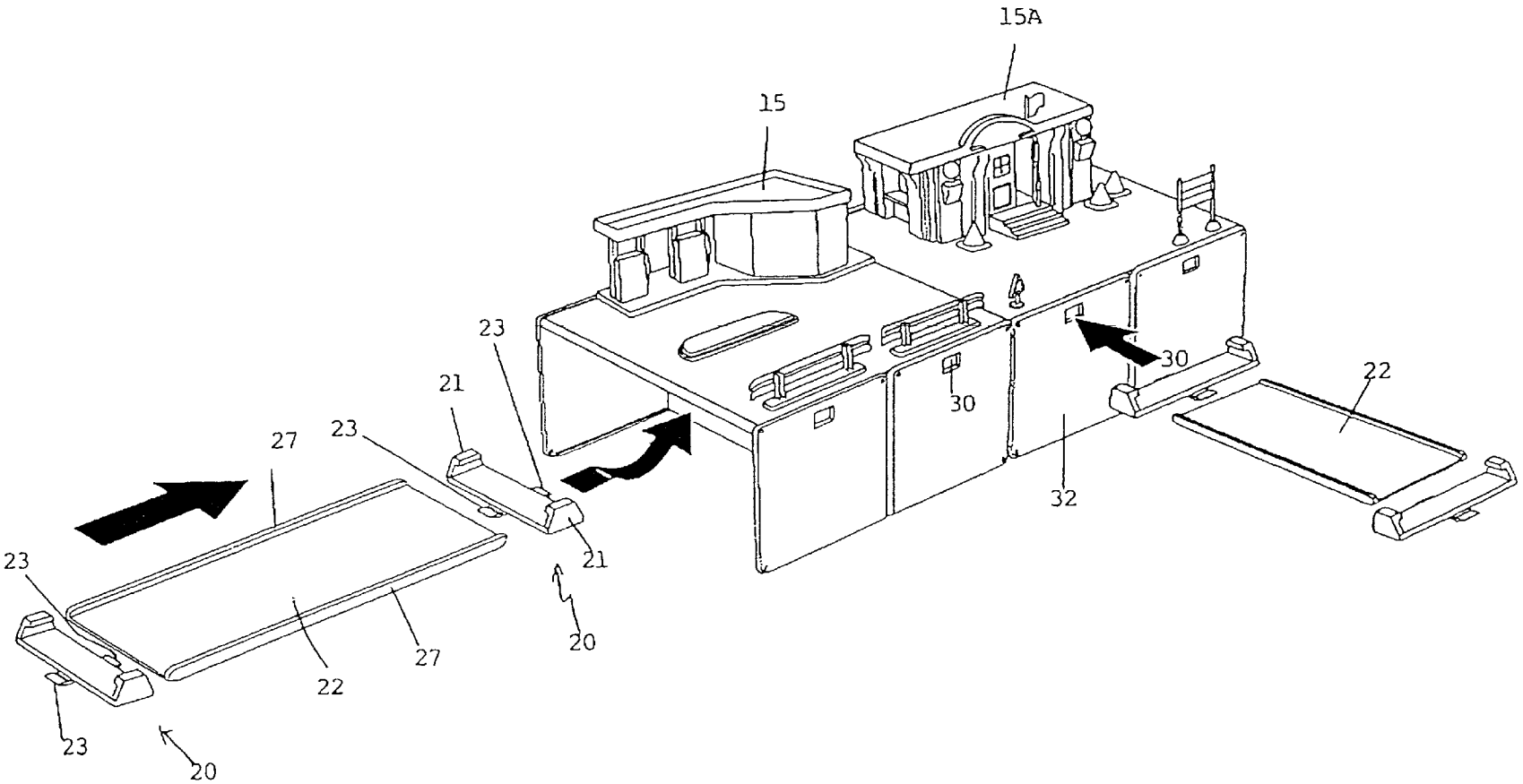
FIG. 7 is a perspective illustration of the side-by-side modules of FIG. 6 and a pair of bridges, each about to be connected to an edge of one of the modules.

As shown in FIG. 7, bridges can be connected to either one of these modules or other modules positioned alongside either of these modules.

Figure 8:
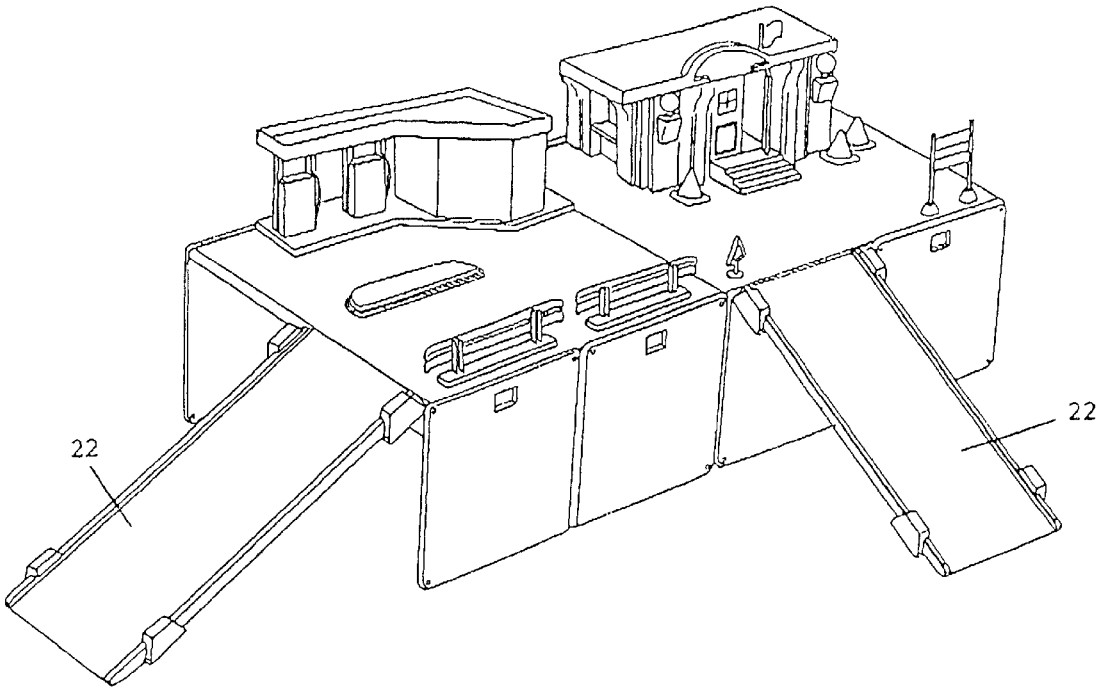
FIG. 8 is a perspective illustration of the modules of FIG. 7 with a pair of ramps each connected to an edge of one of the modules.
Figure 9:
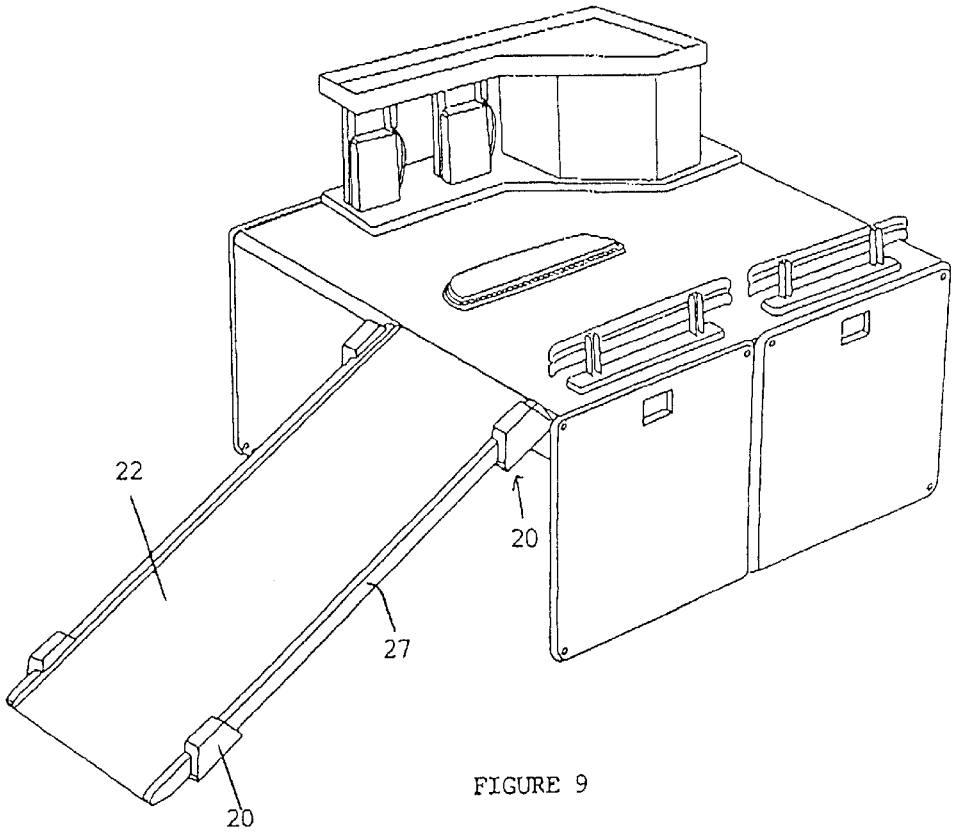
FIG. 9 is a perspective illustration of the single module of FIG. 3 having a ramp connected to an edge thereof.

As an alternative, the bridges 22 can be sloped down to the floor to form a ramp as shown in FIGS. 8 and 9.

Figure 10:
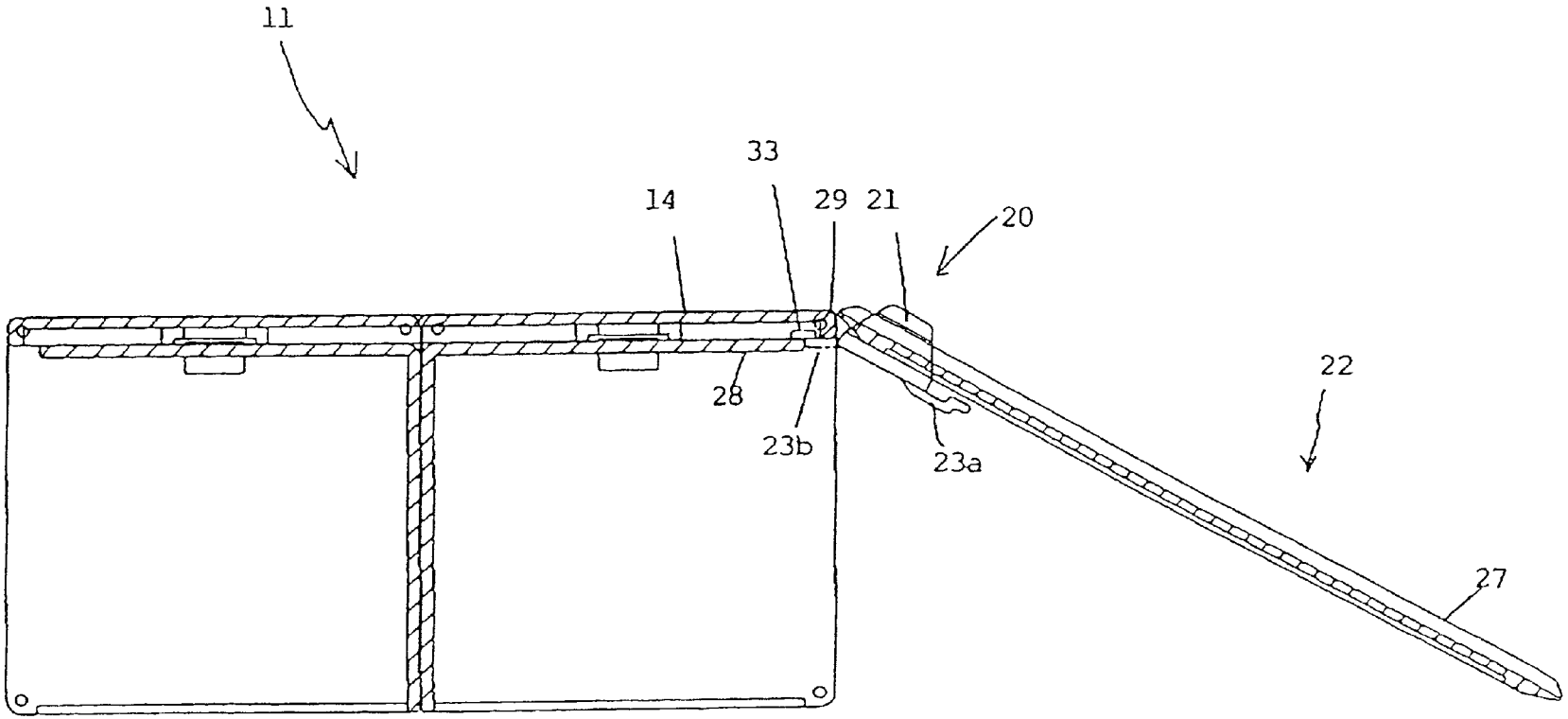
FIG. 10 is a cross-sectional elevational view of a module having a ramp connected thereto.

Turning now to FIG. 10 wherein a bridge 22 is joined to the module 11 as a ramp, the function of the joiner 20 can be further described. The tabs that extended from the joiners 20 are configured differently to one another. One of the tabs 23*a* extends straight out from the joiner 20 whereas the other tab 23*b* extends at an obtuse angle from the joiner 20. The joiner 20 can be reversed from the position shown in FIG. 10 to the position shown in FIG. 11. In the position depicted in FIG. 10, the tab 23*b* fits under a lip 29 and has a thumb portion 33 that sits upon a ledge 28 that is positioned slightly below the platform 14 and recessed slightly back from the edge The lip 29 prevents the thumb 33 from being withdrawn horizontally. The joiner 20 can be removed from the module only after the bridge 22 is first removed from the joiner, or if the module 11 is first lifted off the floor to enable the angle between the bridge and the side wall of the module to be reduced sufficiently to allow withdrawal of the tab.

Figure 11:
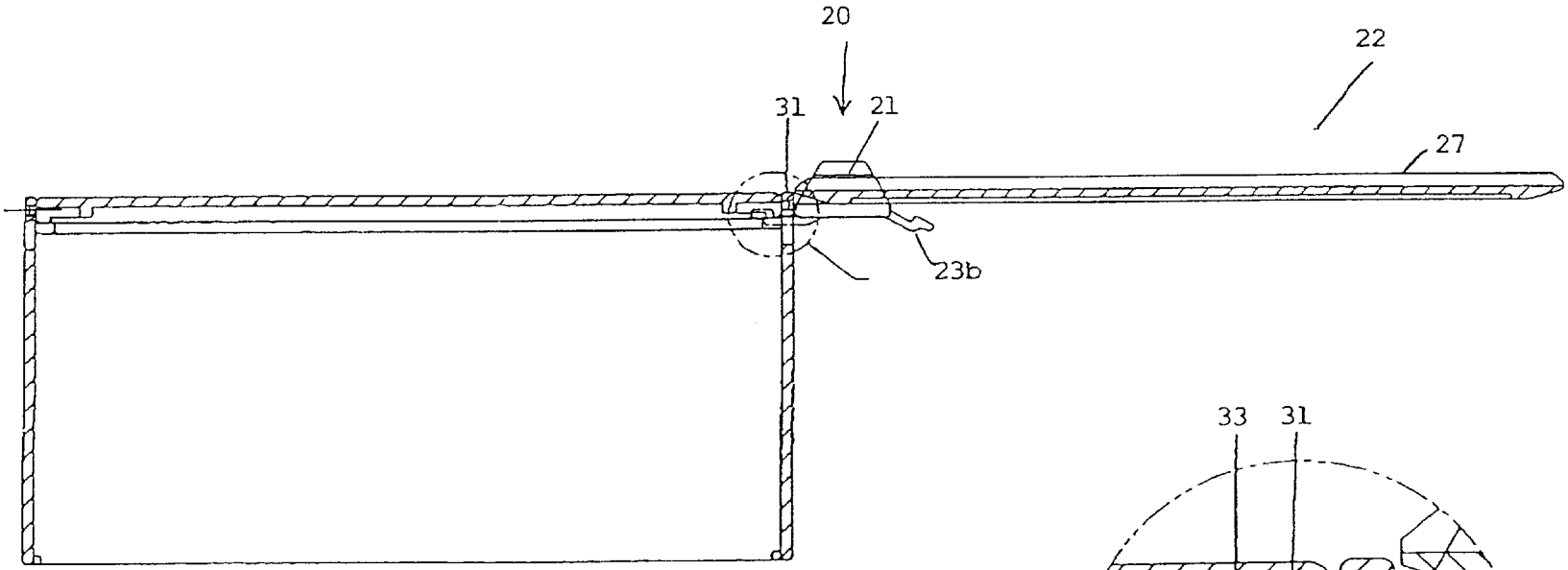
FIG. 11 is a cross-sectional elevational view of a module having a bridge connected thereto by a joiner.
Figure 12:
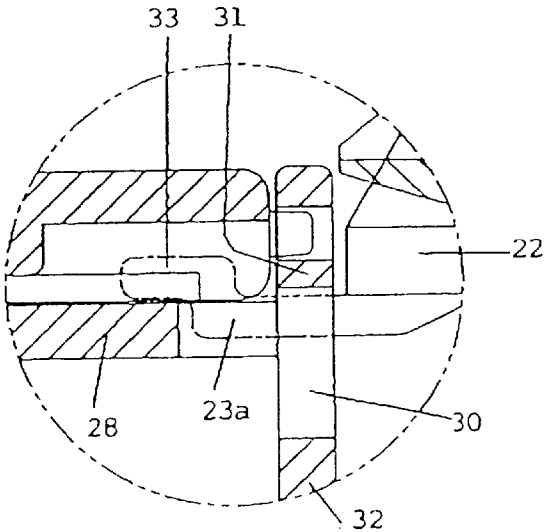
FIG. 12 is a detailed cross-sectional diagram showing the interaction between the joiner and module of FIG. 11.

In the configuration depicted in FIGS. 11 and 12, the tab 23*a* passes through an aperture. 30 in a side wall 32 of the module 11. A thumb portion 33 of the tab 23*a* then rests upon a ledge 28 as described earlier In this configuration, the bridge 22 can extend horizontally between spaced-apart modules. Again, the thumb 33 is constrained by the upper portion 31 of side wall 32 above the aperture 30 to prevent the bridge 22 from falling away from the module unless the module is lifted off the floor for example to reduce the angle between the bridge and the side wall as described earlier.

It should be appreciated that modifications and alterations-obvious to those skilled in the art are not to be considered as beyond the scope of the present invention. For example, instead of a service station configuration provided upon the platform, a game board or any other child-entertaining arrangement can be provided.

What is claimed is:

1. A modular toy station being transformable from a closed storage configuration to an open in-use configuration providing a play surface, the station including a box section and a platform, the box section being hingedly connected to the platform so as to pivot from the storage configuration to the open in-use configuration, the platform having features extending therefrom which are concealed by the box section in the storage configuration and which extend upwardly from the platform in the open in-use configuration, the toy station further including a recessed ledge at an edge of the platform configured to support a tab of a joiner for a ramp or bridge piece.

2. The station of claim 1 having a pair of box sections, each box section hingedly attached to the platform.

3. The station of claim 2 wherein each box section is hingedly attached alongside respective opposed edges of the platform.

4. The station of claim 3 wherein each box section has a wall with an aperture therethrough, and through which said tab passes to be received by the ledge.

5. The station of claim 1, having a ramp having a joiner with a tab, the tab engaging with the ledge.

6. The station of claim 1, connected to a second modular toy station by a bridge having two ends, the two ends having a joiner, said joiners engaged with the ledge on each modular toy station.

7. The station of claim 1 wherein the platform provides a surface for toy vehicles.

8. The station of claim 2 wherein the features extending from the platform are service station features.

* * * * *